US005150699A

United States Patent [19]

Boissevain

[11] Patent Number: 5,150,699

[45] Date of Patent: Sep. 29, 1992

[54] COMPOUND BOW

[76] Inventor: Mathew G. Boissevain, 27181 Sherlock Rd., Los Altos, Calif. 94022

[21] Appl. No.: 441,049

[22] Filed: Nov. 22, 1989

[51] Int. Cl.[5] ..... F41B 5/00

[52] U.S. Cl. ..... 124/25.6; 124/23.1; 124/900

[58] Field of Search ..... 124/16, 17, 208, 21, 124/22, 25, 26, 23 R, 23 A, 24 R, 24 A, DIG. 1, 23.1, 25.6, 24.1, 25.7

[56] References Cited

U.S. PATENT DOCUMENTS

| | | | |
|---|---|---|---|
| 428,912 | 5/1890 | Holmes | 124/25.6 |
| 1,457,983 | 6/1923 | Malone | 124/24 R |
| 1,932,195 | 10/1933 | Stroup | 124/23 R |
| 2,307,021 | 1/1943 | Cordrey et al. | 124/23 R |
| 2,430,685 | 11/1947 | Pearson | 124/16 |
| 2,714,377 | 8/1955 | Mulkey | 124/24 R |
| 3,028,851 | 4/1962 | Drake | 124/16 |
| 3,486,495 | 12/1969 | Allen | 124/24 R |
| 3,518,980 | 7/1970 | Hamm | 124/24 R |
| 3,552,373 | 1/1971 | Van hecke | 124/24 R |
| 3,595,213 | 7/1971 | Storer | 124/23 R |
| 3,674,001 | 7/1972 | Hitt | 124/24 |
| 3,744,473 | 7/1973 | Nishioka | 124/24 R |
| 3,812,835 | 5/1974 | Smith | 124/24 R |
| 3,851,638 | 12/1974 | Alexander | 124/24 R |
| 3,874,359 | 4/1975 | Cesin | 124/16 |
| 3,923,035 | 12/1975 | Trotter | 124/24 R |
| 3,957,027 | 5/1976 | Drake | 124/23.1 |
| 3,967,609 | 7/1976 | Frydenlund | 124/24 R |
| 3,981,290 | 9/1976 | Islas | 124/24 R |
| 3,987,777 | 10/1976 | Darlington | 124/23 R |
| 3,989,026 | 11/1976 | Nishioki | 124/24 R |
| 4,041,927 | 8/1977 | Van House | 124/61 |
| 4,155,342 | 5/1979 | Traweek | 124/16 |
| 4,169,453 | 10/1979 | Hunsicker | 124/20 R |
| 4,201,182 | 5/1980 | Butler | 124/24 R |
| 4,207,859 | 6/1980 | Scholten | 124/24 R |
| 4,227,509 | 10/1980 | Jones | 124/23 R |
| 4,287,867 | 9/1981 | Islas | 124/24 R |
| 4,338,909 | 7/1982 | Plummer | 124/16 |
| 4,388,914 | 6/1983 | Cesin | 124/25 X |
| 4,411,248 | 10/1983 | Kivenson | 124/20 R |
| 4,458,657 | 7/1984 | Stockmar | 124/17 |
| 4,471,747 | 9/1984 | Nishioka | 124/23.1 |
| 4,478,202 | 10/1984 | Anderson | 124/23.1 |
| 4,644,929 | 2/1987 | Peck | 124/23.1 |
| 4,651,707 | 3/1987 | Bozek | 124/17 |
| 4,756,295 | 7/1988 | Guzzetta | 124/25.6 X |

*Primary Examiner*—Randolph A. Reese
*Assistant Examiner*—Jeffrey L. Thompson
*Attorney, Agent, or Firm*—Graham & James

[57] ABSTRACT

A compound archery bow having two rigid bow arms pivotally hinged to opposite ends of a central handle section. Two flexible cables are connected between a single adjustable spring and the bow arms on opposite ends of the central handle section. The two cables properly coordinate the angular rotation of the opposing arms to provide a propelling force vector directly along the axis of the arrow shaft. These cables are attached to the bow arms such that the force needed to draw the bow string back is highest at about mid-draw and minimized at full draw.

16 Claims, 4 Drawing Sheets

COMPOUND BOW

BACKGROUND OF THE INVENTION

1. Field of the Invention

The present invention relates to compound bows for use in archery. More particularly, the present invention relates to a fast shooting, highly accurate and easily strung compound bow which may utilize only a single spring for providing a propelling force to an arrow.

2. Related Art

Historically, bows have been developed and modified to increase arrow velocity and accuracy, yet concurrently decrease the force required to hold the bow in the fully drawn position. As an improvement to the traditional single-piece recurve bow, multiple-piece compound archery bows were developed. In one type of compound bow, cam pulleys are pivotally mounted to the outer ends of the bow arms. Such cam pulleys serve to increase the energy stored in the bow when drawn, without increasing the length of the draw or the holding force required in the fully drawn position. In another type of compound bow, a rigid central handle section is provided and bow arms are pivotally coupled to opposite ends of the handle section. Use of various mechanisms to rapidly pivot these arms upon release of the bow string allows greater force to be imparted to the arrow compared with traditional bows, without adding the mass of cam pulleys to the rapidly moving distal ends of the arms. However, such compound bow designs frequently apply different amounts of torque to the upper and lower cam pulleys or bow arms and produce uncoordinated rotation or pivoting of these cam pulleys or bow arms. As a result, the bow string may not apply a propelling force to the arrow directly along a line defined by the axis of the arrow shaft. This causes irregular and inaccurate arrow flight paths.

In an attempt to counter this problem, bow designers have added synchronization cables and pulleys to such bows to ensure synchronized angular rotation of the cam pulleys and bow arms. However, one problem with the typical compound bow involves the confusing complexity and possible safety hazards produced by the extra cables necessary to synchronize angular rotation of the cam pulleys and bow arms upon release of the bow string. Many presently available compound bows are designed such that the synchronizing cable/pulley mechanisms are located between the central handle section of the bow and the archer. These designs are inherently hazardous in that if the bow string or a cable breaks, dangerous snapping and pulling of the loose string and cables could occur directly in the face of the archer. Also, the additional mass of these synchronizing pulleys and cables slows rotation of the cam pulleys or bow arms, thus decreasing arrow velocity.

Another problem with such designs is that the hand grip is conventionally centered on the bow such that the archer holds the bow midway between its top and bottom. This means that the arrow will be nocked above the center of the bow and thus closer to the upper cam pulley or bow arm than to the lower cam pulley or bow arm. As a result, even if the synchronizing cables and pulleys are successful in achieving exactly synchronized rotation of the upper and lower cam pulleys or bow arms, and in applying exactly equal torque to both cam pulleys or bow arms, the bow string will still not apply a propelling force directly along the arrow shaft. Thus, such designs are inherently flawed.

In another attempt to overcome problems inherent in previously known bow designs, a single spring device has been mounted to the central handle section of a bow. One bow arm, the "master" arm, is attached directly to the spring device by rigid mechanical linkages Another bow arm, the "slave" arm, may be attached to the master arm with a cable routed through the central handle section of the bow. Unfortunately, however, with this design, substantial synchronization errors may be produced by the stretching of the cable interconnecting the master and slave arms. That is, the master arm will begin to rotate immediately upon release of the bow string because this arm is connected by rigid mechanical linkage to the spring. There will then be a time delay, as the interconnecting cable stretches, before the slave arm will also begin to rotate. Thus, accurate coordination of the bow arms when the bow string is released would appear to be difficult or impossible using this design.

In a variation of this design, instead of a cable, rigid mechanical linkage interconnects the master and slave arms. However, like the cable, the interconnecting linkage may also be subject to stretching, and will therefore have the same adverse effects associated with the previously mentioned design. Moreover, if the linkage or interconnecting cable is made sufficiently heavy such that no appreciable stretching occurs, then the added mass will slow rotation of the arms upon release of the bow string. Furthermore, the "play" in the hinges interconnecting the bow arms with the linkage adds to the problem of properly coordinating bow arm rotation.

Also, when a conventional compound bow is in the released or "braced" position, the bow arms extend in almost exactly opposite directions. Thus, any rotational force on the arms can be resisted only by a much larger tension in the bow string. As a result, many conventional bow designs require that, to avoid breaking the bow string, the bow arms sustain only a relatively small rotational force when in the braced position. The energy stored in the bow in the braced position is known as the "pre-load". As a result of this limitation on preload, the initial portion of the draw in conventional compound bows is substantially wasted since only a small amount of energy is added to the bow when the archer first begins to draw back the bow string.

Greater accuracy and arrow velocity may be achieved if the rotation of the bow arms could be properly coordinated, without the use of a complicated synchronizing pulley and cable system, and if greater amounts of energy could be stored in the bow during the initial portion of the draw.

SUMMARY OF THE INVENTION

The invention includes a bow body having a central handle section with upper and lower arms pivotally attached thereto. A hand grip may be located on the central handle section midway between the top and bottom of the bow. The arrow rest is located above the hand grip, and therefore, when the hand grip is centered on the bow, the arrow rest will be positioned above the bow centerline. A single spring is mounted to the central handle section on the front side of the bow away from the archer. Positioning the spring at this location helps to balance the bow and also increases safety by keeping moving parts away from the archer.

Two cables are attached at one end to adjacent locations on the spring and are connected at their opposite ends to opposing bow arms. The spring, operating through the cables, provides rotational force to the bow arms upon release of the bow string. Since both cables are attached to adjacent locations of the same spring, accurate coordination of the angular rotation of the bow arms is automatically achieved without the need for the complicated synchronizing cable/pulley system of conventional compound bows. Moreover, the elastic properties of the cables will not adversely affect the coordinated rotation of the bow arms upon release of the bow string, since both cables are of the same or similar gauge and the difference in the lengths of the two cables is not great. Thus, any effect on bow arm rotation caused by the elastic properties of one cable are matched by the substantially similar elastic properties of the other cable. In addition, the cables are connected to the bow arms such that the draw force of the bow string is minimized at or near the maximum draw distance, in order to allow for more stable aim when the bow string is fully drawn.

Because of the geometry of the present bow, even though the arrow is not necessarily centered relative to the bow body, the projecting force is still imparted to the arrow by the bow string directly along a line defined by the axis of the arrow shaft. For example, as previously mentioned, the arrow rest may be disposed above the centerline of the bow. In this configuration, the cables transmitting rotational force to the bow arms may be connected between the spring and the arms such that the spring applies greater torque to the lower arm than to the upper arm. Since the arrow knocking point is further along the bow string from the lower arm than from the upper arm, the magnitude of this torque differential between the arms may be adjusted such that the bow string applies a net force to the arrow directly along the axis of the arrow shaft. Thus, the flight path of the arrow is straight, long and highly accurate.

The present invention also provides an adjusting means for placing the spring in variable amounts of elastic deformation or "pre-load" when the bow is in the braced position. Thus, since the spring of the present invention is elastically deformed before the bow string is drawn, the archer begins to store substantial amounts of energy in the spring as soon as he or she begins to pull back on the bow string. Therefore, the draw of the present bow is highly efficient.

The present bow is also extremely easy to string. With conventional bow designs where all of the spring pre-load is absorbed by the string, the archer must strain against the restoring force of the bow until the bow arms are bent such that the bow string can be connected therebetween. However, to string the present bow, it is only necessary to increase the pre-load on the spring using the previously mentioned adjusting means. For example, assume that a leaf spring is used. As the leaf spring is bent with the adjusting means, the bow arms automatically pivot toward each other. The bow string can then be easily connected between the opposing bow arms. The adjusting means may then be re-adjusted to allow the leaf spring to return to its original pre-loaded position, thereby placing the bow string under tension. Thus, the archer can string the bow of the present invention easily and efficiently, without straining against the restoring force of the spring.

DETAILED DESCRIPTION OF THE DRAWINGS

The following description is of the best presently contemplated modes of carrying out the invention. In the accompanying drawings, like numerals designate like parts in the several figures. This description is made for the purpose of illustrating the general principles of the invention and should not be taken in a limiting sense. The scope of the invention is best determined by reference to the accompanying claims.

Figure 1:
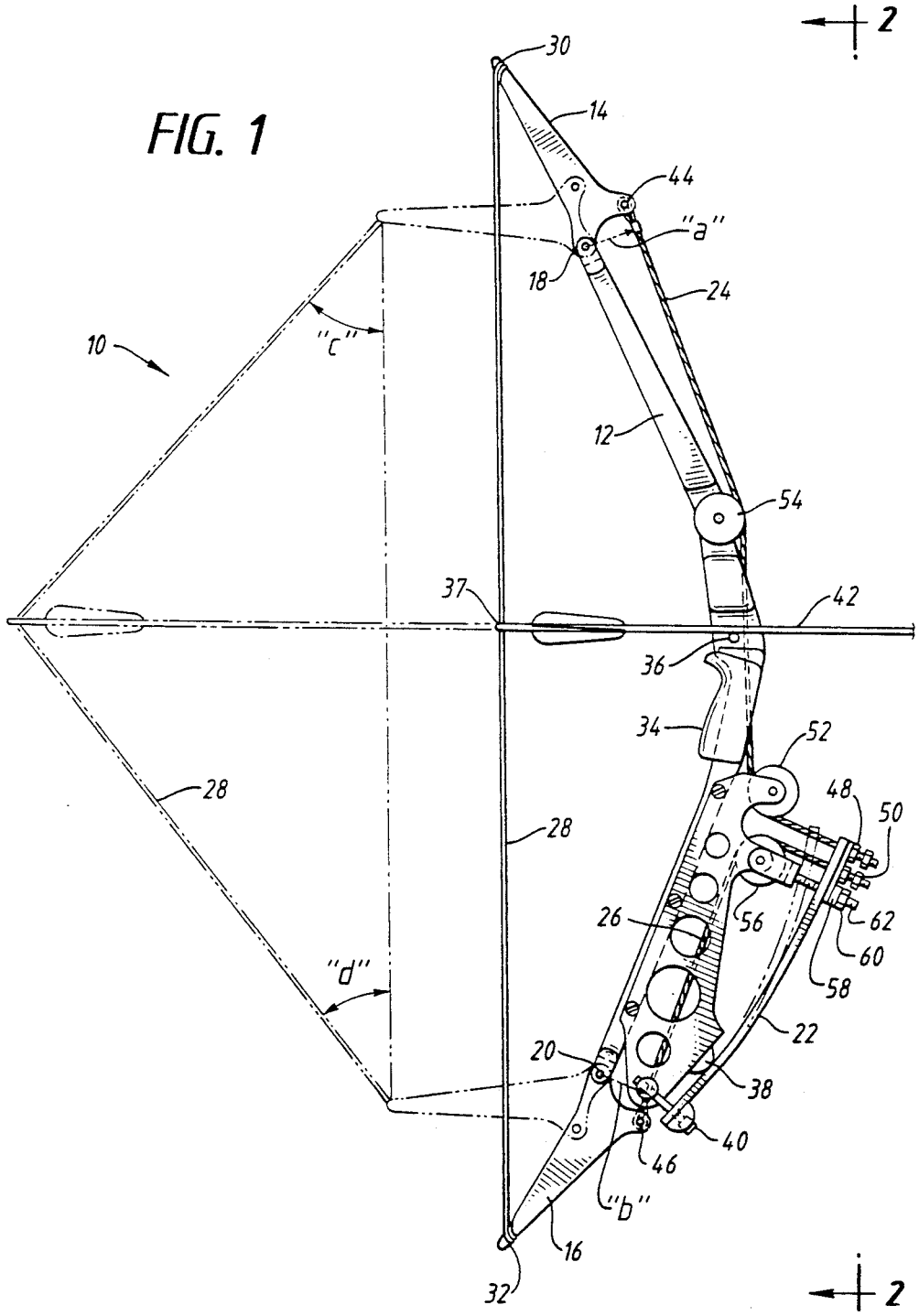
FIG. 1 is a side view of an embodiment of the archery bow of the present invention. The bow is shown both in the braced position and at full draw (phantom lines).
Figure 2:
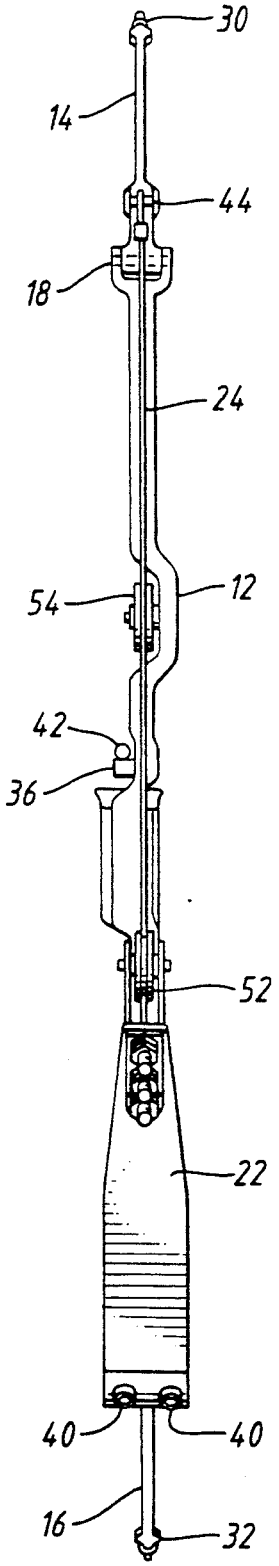
FIG. 2 is a front view of the embodiment of FIG. 1 taken along line 2—2.

FIG. 1 shows a side view of one embodiment of the compound bow 10 of the present invention. FIG. 2 is a front view of this same embodiment. The compound bow 10 is shown in FIG. 1 in the braced and fully drawn (in phantom lines) positions. The bow 10 is formed with a rigid or only slightly flexible elongated central handle section 12 and two bow arms 14 and 16 pivotally hinged to opposite ends of the central handle section 12 by hinges 18 and 20, respectively. A tapered single leaf spring 22 is mounted to the front of the central handle section 12. Cables 24, 26 interconnect the tapered end of the leaf spring 22 and bow arms 14, 16 so that the spring 22 provides tension in, and exerts a force against, the bow string 28, which is attached between bow arms 14 and 16 at bow string connecting locations 30 and 32, respectively. These connecting locations 30, 32 may include, for example, hooks, grooves or other connectors for coupling the bow string 28 to the bow arms 14 and 16, respectively.

A hand grip 34 is positioned midway between the ends of the bow 10 and the arrow rest 36 is disposed above the hand grip 34. The arrow knocking point 37 (where the arrow 42 perpendicularly contacts the bow string 28 of the braced bow 10) is, therefore, a greater distance along the bow string 28 from connecting location 32 than from connecting location 30.

The leaf spring 22 may be made of carbon and/or glass fibers to maximize bending stiffness and strength while minimizing weight. The single leaf spring 22 is a cantilevered spring which is pressed against a fulcrum 38 near the bottom half of the leaf spring 22. Tension adjusting screws 40 are located at the lower-most end of the leaf spring 22, for adjustment of the tension in the the spring 22 by pivoting the spring 22 about the fulcrum 38, according to the draw weight requirements of the archer and the desired force to be imparted to the arrow 42. Adjustment of these screws 40 is extremely simple and allows precision control of very small incremental changes in pre-load. Advantageously, the adjustability of tension at a single location in the one leaf spring 22 does not affect the coordinated movement of the bow arms 14, 16, as occurs with the adjustments of springs in many previous bow designs.

Still referring to FIGS. 1 and 2, the two cables 24 and 26 attached to the upper half of the leaf spring 22 are oppositely routed along the central handle section 12 and connected to respective bow arms 14 and 16. One end of cable 24 is attached to an uppermost part of the leaf spring 22, while the opposite end of this cable 24 is pivotally attached to the upper bow arm 14 at hinge 44. Similarly, one end of cable 26 is also attached to the leaf spring 22, but directly below the point of attachment of cable 24. The opposite end of cable 26 is attached to the lower bow arm 16 at hinge 46. Adjustment nuts 48 and 50 may be used to individually adjust the tensions in cables 24 and 26, respectively. The adjustment of tension in each of the cables may vary according to the types and elasticities of flexible cable material used. Pulleys 52, 54 and 56 act as cable guides.

A shock absorbing washer 58 is placed between the leaf spring 22 and the spring pre-loading nut 60 on bolt 62. As the bow string 28 is drawn back, the cables 24, 26 pull on the leaf spring 22 which slides along the smooth shaft portion of the bolt 62 toward the central handle section 12. Upon release of the bow string 28, the restoring force of the spring 22 snaps the upper portion of the spring 22 back along the bolt 62 until movement of the spring 22 is stopped by the shock absorbing washer 58. This washer 58 is made of tough, resilient material, such as urethane rubber, so that it absorbes and damps deceleration forces that are applied to the leaf spring 22 following release of the bow string 28.

In many conventional bows, if the bow string is accidentally released without an arrow, then the bow string, bow body and any synchronizing cables are forced to absorb all the energy previously stored in the bow. This can damage the bow and also result in dangerous snapping of the cables and bow string. However, with the present bow, this energy is safely absorbed by the urethane washer.

The spring pre-loading nut 60 and bolt 62 serve at least two purposes. First, the nut 60 can be tightened to provide, in combination with adjusting screws 40, an adjustable pre-load on the leaf spring 22 such that this spring 22 is deformed under very high bending forces, even when the bow 10 is in the braced position. As previously mentioned, this permits the archer to begin storing large amounts of energy in the spring 22 even as the bow string 28 is just beginning to be drawn back. Thus, the pre-load is not limited by the tensile strength of the bow string 28, as in many conventional bow designs. Secondly, this adjusting nut 60 makes it extremely easy to string the bow 10. The nut 60 can be tightened past its normal pre-load position so that, as the nut 60 is tightened, the range of movement of the upper portion of the leaf spring 22 becomes increasingly limited and the bow arms 14, 16 pivot toward each other. The bow string 28 can then be easily connected to the bow arms 14, 16 at connection locations 30 and 32. When the nut 60 is loosened to return the spring 22 to its normal pre-load position, the bow string 28 is placed in tension.

Figure 3:
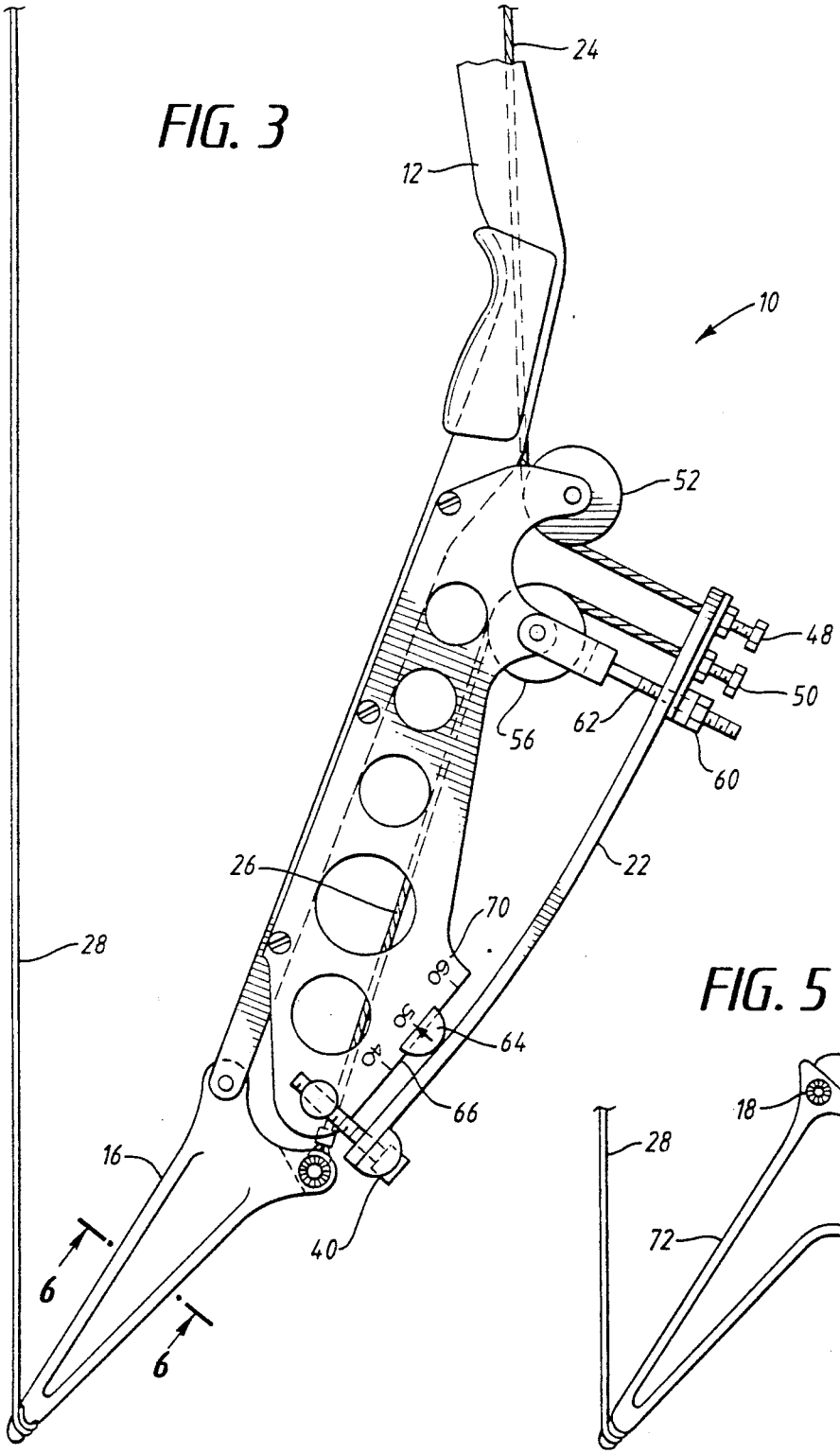
FIG. 3 is an enlarged side view of the lower portion of an alternative embodiment of a bow according to the present invention. This figure illustrates a spring force changing mechanism.

FIG. 3 illustrates an alternative way to mount the spring 22 to the central handle section 12. As illustrated in this figure, the lower end of the spring 22 is securely fastened to the central handle section 12 with tension adjusting screws 40. The upper end of the spring 22 is fastened to the cables 24, 26 and to bolt 62 in the same manner as previously explained in connection with the embodiment of FIG. 1. However, in the FIG. 3 embodiment, the fulcrum includes a slidable half-round spacer 64 disposed between the leaf spring 22 and the central body section 12. This spacer 64 is slidable along a track 66 to thereby alter the draw weight of the bow 10 as the spacer 64 is moved back and forth along the track 66. The draw weight for the various positions of the spacer 64 may be inscribed along the side of the central handle section 12, as shown at 70.

Figure 4:
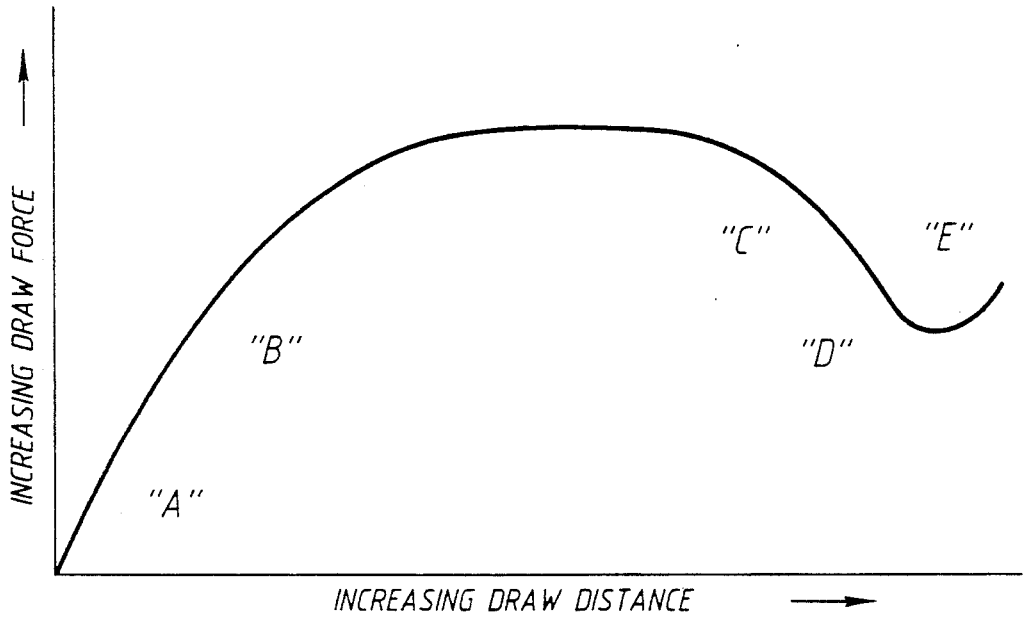
FIG. 4 is a graph illustrating the draw force verses draw distance characteristic of the present bow.

FIG. 4 is a graph illustrating the draw weight vs. draw distance characteristics of the bow of FIGS. 1-3. In either of the previously described embodiments of FIGS. 1-3, as the bow string 28 is drawn back, the bow arms 14, 16 are angularly displaced about the hinges 18, 20. As shown at "A" in FIG. 4, initially, the draw force required to pull back the bow string 28 is relatively low because the string 28 is substantially straight between the string connection locations 30, 32. Moreover, as shown at "B" in FIG. 4, because of the pre-load applied to the spring 22 by nut 60, as the bow string 28 is drawn back, the spring tension is already very high and, therefore, the draw force increases rapidly. However, with increasing draw both the spring force and the angles between the bow string 28 and bow arms 14, 16 increase until, at about mid-draw, the force required to hold the bow string 28 back is greatest.

As the bow string 28 is drawn farther back past mid-draw, the draw force becomes perceptibly less. Cables 24 and 26, connected at hinges 44 and 46, form moment vectors "a" and "b", equal to the distance from the bow arm hinges 18 and 20 to the cables 24, 26, respectively, measured perpendicularly to these cables. After mid-draw, as the bow string 28 is still being drawn back and the bow arms 14, 16 continue to rotate, the rapid decrease the length of the moment vectors "a" and "b" lessens the force needed to rotate the bow arms 14, 16 about their respective hinges 18, 20, even though the spring-induced tension in the cables 24, 26 is still increasing. FIG. 4 shows this rapid decrease in draw force at "C". At full draw, "D", the force needed to hold the bow string 28 back is minimal, thereby providing for greater control of the bow 10 and better aim at a target (not shown) immediately before the bow string 28 is released.

Figure 5:
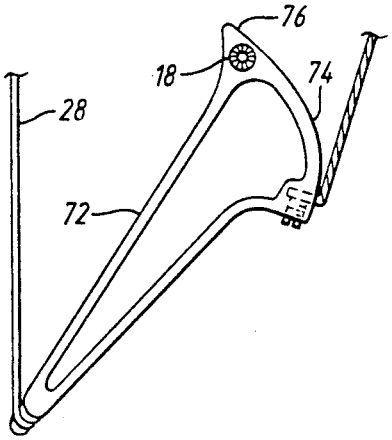
FIG. 5 illustrates an alternative embodiment of a pivoting bow arm having a cam surface.

In an alternative embodiment, illustrated in FIG. 5, the bow arms of FIGS. 1-3 may be replaced with bow arms having cam surfaces 74 along which the connecting cables ride as the bow 10 is drawn. FIG. 5 illustrates only a lower bow arm 72. However, an identical upper bow arm would also be utilized in such a bow. According to this alternative embodiment, the curvature of the cam surface 74 may be altered to change the relationship between spring tension and draw force, as needed to suit a particular archer. The cam surface 74 preferably extends outwardly of the hinge 18, as shown at 76, to thereby provide a rapid increase in draw force near the end of the draw. The increase in draw force near the end of draw is desirable to provide a clear indication to the archer when the bow is in the fully drawn position. This increase in draw force is shown at "E" in FIG. 4.

With reference to FIG. 1, it will be noted that, since the arrow rest 36 is above the mid-point of the bow 10, the angle "c", formed between the drawn bow string 28 and vertical, is greater than the angle "d", also formed between the drawn bow string 28 and vertical. Simultaneously, however, cable 24 is mounted to the leaf spring 22 at a point further from the fulcrum 38 than is cable 26. Thus, as the leaf spring 22 returns to a braced position upon release of the arrow 42, the tension in cable 26 is greater than the tension in cable 24. The combination of these two factors, the difference in angles "c" and "d" and the difference in cable tensions combine in the present compound bow design such that the bow string 28 applies a propelling force to the arrow 42 with a force vector aligned directly along the axis of the arrow shaft. Stated differently, this force vector is aligned with the axis of the arrow shaft when the ratio of tensions in the two portions of the bow string 28 above and below the knocking point 37 is equal to the ratio of the lengths of the bow string 28 above and below the knocking point 37. Therefore, when the force vector is aligned with the axis of the arrow shaft, upon release of the bow string 28, the arrow 42 will be projected straight out of the bow 10. Thus, the bow 10 of the present invention is exceptionally accurate.

Moreover, with any of the previously mentioned embodiments, not only are both of the cables 24, 26 attached to adjacent locations of a single spring 22, but in addition, these cables are both in tension when the bow 10 is fully drawn. Therefore, upon release of the bow string 28, both cables 24, 26 will begin rotating the respective bow arms 14, 16 at the same instant. Thus, with the present bow design, the elastic properties of the cables 24, 26 do not induce any inaccuracies into the proper coordination of bow arm rotation.

Figure 6:
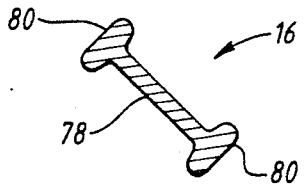
FIG. 6 illustrates an I-beam cross-section through the lower bow arm of FIG. 3 taken along line 6—6 in FIG. 3.

FIG. 6 illustrates a cross-section through the lower bow arm 16 in FIG. 3. As shown here, the bow arms 14, 16 have an I-beam structure with a narrow center web 78 and wider flanges 80 disposed on opposite sides of the web 78. This I-beam structure is utilized to maximize bow arm strength and rigidity, while minimizing the mass of the arms. Thus, this I-beam construction, relative to conventional bow arms, provides for a more rigid but lighter arm which, in turn, allows faster angular rotation of the bow arms 14, 16 for a given spring force. Faster bow arm rotation is desirable to increase the velocity of the arrow 42 upon release of the bow string 28.

Figure 7:
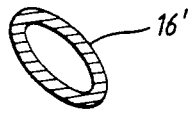
FIG. 7 illustrates an alternative bow arm construction utilizing a hollow oval cross-section. This figure illustrates a cross-section through the lower bow arm as it would appear if also taken along line 6—6 in FIG. 3.

Alternatively, the bow arms 14, 16 may have a hollow oval cross-section, as shown in FIG. 7 and indicated as reference numeral 16'. Such a hollow oval cross-section provides substantially the same benefits of increased strength and rigidity to weight ratios as an I-beam cross-section, but with a smoother appearance and less wind resistance.

The present compound bow 10 may be made lighter, more accurate, and safer than many existing bows, yet it is also extremely easy to use and does not require the complex and massive synchronizing cables, pulleys and linkage systems of many prior compound bow designs. The lack of these excess cables, pulleys and linkages creates a smooth draw and quiet release.

Although the present invention has been described in terms of several specific embodiments, it will be understood that various modifications may be made without departing from the spirit and scope of the invention. Accordingly, it is to be understood that the invention is not to be limited by the specific illustrated embodiments, but only by the scope of the appended claims and equivalents thereof.

I claim:

1. An archery bow which is supported by one hand of an archer and moved from a braced position to a drawn position and maintained in the drawn position prior to release by the other hand of the archer, comprising:

a central handle section;

first and second arms pivotally coupled to opposite ends of the handle section;

a spring mounted to the handle section, the spring having connection locations; and first and second members, one end of each of the first and second members being connected to the spring at the connection locations, the other end of the first member being connected to the first arm and the other end of the second member being connected to the second arm, such that when the arms are pivoted from a braced position toward a drawn position, the spring is deformed and exerts a restoring force on the arms through the members to return the arms toward the braced position.

2. The bow of claim 1, further comprising pre-load means for adjustably deforming the spring when the bow is in the braced position.

3. The bow of claim 1, further comprising shock absorbing means for absorbing energy stored in the bow when the bow is shot without an arrow to prevent damage to the bow.

4. An archery bow, comprising:

a central handle section;

first and second arms pivotally coupled to opposite ends of the handle section;

a leaf spring mounted to the handle section, the leaf spring having connection locations;

first and second cables, one end of each of the first and second cables being connected to the leaf spring at the connection locations, the other end of the first cable being connected to the first arm and the other end of the second cable being connected to the second arm, such that when the arms are pivoted, the leaf spring is deformed and exerts a restoring force on the arms through the cables; and a fulcrum, wherein the leaf spring is in contact with the fulcrum, and the connection locations are disposed at differing distances from the fulcrum.

5. The bow of claim 4, further comprising:

a bow string interconnecting the distal ends of the arms; and an arrow rest disposed on the handle section to provide an arrow knocking point displaced from the center of the bow string, the connection locations being disposed at such distances from the fulcrum that the ratio of bow string lengths on opposite sides of the knocking point is approximately equal to the ratio of tensions produced by the spring in the respective lengths of bow string when the bow is drawn.

6. The bow of claim 5, wherein the arrow knocking point is closer to the first arm than to the second arm and the connection location for the first cable is disposed further from the fulcrum than the connection location for the second cable.

7. An archery bow, comprising;

a central handle section;

first and second arms pivotally coupled to opposite ends of the handle section;

a spring mounted to the handle section, the spring having connection locations;

first and second members, one end of each of the first and second members being connected to the spring at the connection locations, the other end of the first member being connected to the first arm and the other end of the second member being connected to the second arm, such that when the arms are pivoted, the spring is deformed and exerts a restoring force on the arms through the members to move the arms toward a braced position; and pre-load means for adjustably deforming the spring when the bow is in the braced position, wherein the pre-load means includes limiting means for limiting the movement of the connection locations from movement in a direction tending to restore the spring to an undeformed shape.

8. The bow of claim 7, wherein the limiting means is adjustable for limiting the movement of the connection locations to a plurality of selectable positions.

9. An archery bow, comprising:

a central handle section;

first and second arms pivotally coupled to opposite ends of the handle section;

a leaf spring mounted to the handle section, the leaf spring having connection locations;

first and second cables, one end of each of the first and second cables being connected to the spring at the connection locations, the other end of the first cable being connected to the first arm and the other end of the second cable being connected to the second arm, such that when the arms are pivoted, the leaf spring is deformed and exerts a restoring force on the arms through the cables;

a bolt mounted to the handle section; and a nut rotatably fastened to the distal end of the bolt, the nut and bolt being disposed such that rotation of the nut forces the not toward the leaf spring to deform the leaf spring.

10. The bow of claim 9, further comprising an elastic shock absorbing member disposed between the spring and the nut.

11. An archery bow, comprising:

a central handle section;

first and second arms pivotally coupled to opposite ends of the handle section;

a leaf spring mounted to the handle section, the leaf spring having connection locations;

first and second members, one end of each of the first and second members being connected to the spring at the connection locations, the other end of the first member being connected to the first arm and the other end of the second member being connected to the second arm, such that when the arms are pivoted, the leaf spring is deformed and exerts a restoring force on the arms through the members; and a fulcrum in contact with the leaf spring, wherein the fulcrum is movable to a plurality of locations along the length of the leaf spring for changing the draw weight of the bow.

12. The bow of claim 11, further comprising a track disposed adjacent to and running along the length of the leaf spring, wherein the fulcrum is movable along the track for changing the draw weight of the bow.

13. An archery bow, comprising:

a central handle section;

first and second arms pivotally coupled to opposite ends of the handle section;

a bow string interconnecting distal ends of the arms;

an arrow rest disposed on the handle section to produce an arrow knocking point spaced from the center of the bow string and defining first and second unequal lengths of bow string on opposite sides of the knocking point, the first length spanning the distance from the knocking point to the first arm and the second length spanning the distance from the knocking point to the second arm; and tension means for producing different tensions in the first and second lengths of bow string when the bow is drawn such that the ratio of tensions in the first and second lengths of bow string is approximately equal to the ratio of the first and second lengths of bow string, respectively.

14. An archery bow, comprising:

a central handle section;

first and second arms pivotally coupled to opposite ends of the handle section;

a bow string interconnecting distal ends of the arms;

an arrow rest disposed on the handle section to produce an arrow knocking point spaced from the center of the bow string and defining first and second unequal lengths of bow string on opposite sides of the knocking point, the first length spanning the distance from the knocking point to the first arm and the second length spanning the distance from the knocking point to the second arm; and tension means for producing different tensions in the first and second lengths of bow string when the bow is drawn such that the ratio of tensions in the first and second lengths of bow string is approximately equal to the ratio of the first and second lengths of bow string respectively, wherein the tension means includes a leaf spring mounted to the central handle section, a fulcrum in contact with the leaf spring and first and second cables interconnecting the leaf spring with the first and second arms, respectively, and wherein the first length of bow string is shorter than the second length of bow string and the first cable is connected to the leaf spring at a greater distance from the fulcrum than the second cable.

15. An archery bow, comprising:

a central handle section;

a spring;

a cable having one end thereof connected to the spring; and a pivotable arm, wherein the arm includes a pivot connected to the handle section, a bow string connector spaced along the arm from the pivot and a cable connector connecting the arm to the end of the cable opposite the spring, the cable connector being spaced on the arm from both the pivot and the bow string connector, wherein the arm further includes a cam surface, the cam surface extending along the arm from the cable connector toward the pivot such that, upon pivoting the arm, the cable engages different portions of the cam surface.

16. The bow of claim 15, wherein the cam surface extends beyond the pivot on the side of the pivot opposite the connector.

* * * * *